US011660612B2

(12) United States Patent
Mackel et al.

(10) Patent No.: US 11,660,612 B2
(45) Date of Patent: May 30, 2023

(54) METHOD FOR PROCESSING A FLOWABLE PRODUCT BY ELECTRICALLY CHARGING PARTICLES IN THE FLOWABLE PRODUCT AND A DISC STACK OF A CENTRIFUGE

(71) Applicant: GEA Mechanical Equipment GmbH, Oelde (DE)

(72) Inventors: Wilfried Mackel, Lippetal-Herzfeld (DE); Klaus-Peter Eickhoff, Rheda-Wiedenbrueck (DE); Marc Kellens, Muizen (BE); Knud Schoeneberg, Stade (DE); Detlef Ullmann, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 486 days.

(21) Appl. No.: 16/759,069

(22) PCT Filed: Oct. 23, 2018

(86) PCT No.: PCT/EP2018/078970
§ 371 (c)(1),
(2) Date: Apr. 24, 2020

(87) PCT Pub. No.: WO2019/081469
PCT Pub. Date: May 2, 2019

(65) Prior Publication Data

US 2020/0338572 A1 Oct. 29, 2020

(30) Foreign Application Priority Data

Oct. 26, 2017 (DE) ..... 10 2017 125 057.3

(51) Int. Cl.
*B04B 5/10* (2006.01)
*B03C 5/00* (2006.01)
(Continued)

(52) U.S. Cl.
CPC ..... *B04B 5/10* (2013.01); *B03C 5/00* (2013.01); *B04B 1/08* (2013.01); *B04B 11/02* (2013.01)

(58) Field of Classification Search
CPC .. B04B 5/10; B04B 1/08; B04B 11/02; B03C 5/00
(Continued)

(56) References Cited

U.S. PATENT DOCUMENTS 1,558,382 A * 10/1925 Marx ..... B04B 1/08 209/127.1
3,126,338 A * 3/1964 Steinacker ..... B04B 7/02 494/48
2016/0375447 A1 12/2016 Hirata et al.

FOREIGN PATENT DOCUMENTS

DE 10 2006 022156 A1 11/2007
DE 102006022156 A1 * 11/2007 ..... B03C 11/00
(Continued)

OTHER PUBLICATIONS

JPH03143560 J-Plat Pat Machine Translation.*
(Continued)

*Primary Examiner* — Shuyi S. Liu
(74) *Attorney, Agent, or Firm* — Crowell & Moring LLP

(57) ABSTRACT

A method for processing a flowable product using a centrifuge includes pretreating the flowable product so that particles in the flowable product are increasingly attracted by electrically charged components, feeding the flowable product into the disc stack, generating an electric charge on the discs of the disc stack, and separating the charged particles from the flowable product within the disc stack under the influence of electrostatic attractive forces and a centrifugal field.

4 Claims, 1 Drawing Sheet

(51) Int. Cl.
*B04B 1/08* (2006.01)
*B04B 11/02* (2006.01)

(58) Field of Classification Search
USPC ..... 494/1, 2, 3, 79
See application file for complete search history.

(56) References Cited

FOREIGN PATENT DOCUMENTS

| | | | | | |
|---|---|---|---|---|---|
| EP | 1 854 544 | A2 | | 11/2007 | |
| JP | 2-78454 | A | | 3/1990 | |
| JP | 3-143560 | A | | 6/1991 | |
| JP | H03143560 | | * | 6/1991 | ..... B04B 1/08 |
| SU | 551036 | A1 | | 3/1977 | |

OTHER PUBLICATIONS

PCT/EP2018/078970, International Search Report (PCT/ISA/210) dated Jan. 30, 2019, with English translation (Six (6) pages).
German Search Report issued in German application No. 10 2017 125 057.3 dated Aug. 16, 2018, with Statement of Relevancy (Ten (10) pages).

* cited by examiner

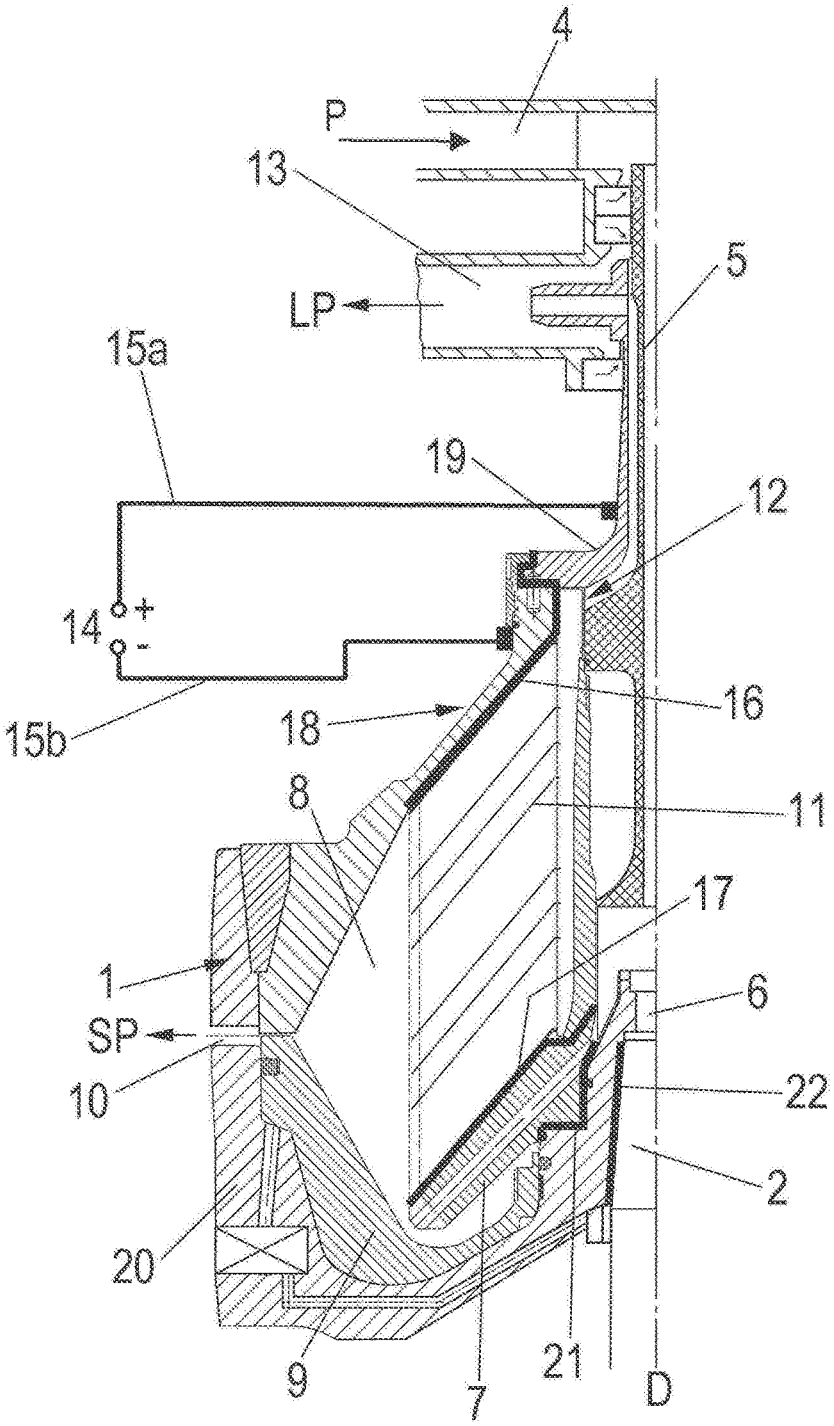
4
P
13
5
LP
15a
19
12
14
+
-
16
15b
18
8
11
17
1
6
SP
10
22
2
20
9
7
21
D

METHOD FOR PROCESSING A FLOWABLE PRODUCT BY ELECTRICALLY CHARGING PARTICLES IN THE FLOWABLE PRODUCT AND A DISC STACK OF A CENTRIFUGE

BACKGROUND AND SUMMARY OF THE INVENTION

The invention relates to a method for processing a flowable product and a centrifuge, in particular a separator.

DE 10 2006 022 156 A1 discloses a method and a device for the treatment of liquids in which an inflowing flowable product is separated in a centrifuge into two liquid phases and a solid phase. The product, e.g., a contaminated lubricating oil, is separated into two partial streams which are led past a positive or negative electrode. The particles contained in the first partial flow are positively charged and the particles of the second partial flow are negatively charged. Before the liquid is introduced into the centrifuge, both partial streams are combined in a collection tank, wherein the positively charged particles and the negatively charged particles conglomerate into larger particle clusters due to the mutual electrostatic attraction. These conglomerates are then easier to separate from the liquid in the centrifugal field.

SU 5 51 036 discloses a centrifuge that allows electrostatic charging of particles within a non-continuously operating centrifuge. For this purpose, an electrode is arranged in an inlet chamber on the rotational axis of the centrifuge. After the electrostatic charging of the particles, they are transferred to a drum chamber where the particles are separated in solids collection pockets. The clarified liquid is then discharged from the centrifuge. The solids collection pockets are embedded in the wall of the centrifuge. Unlike a conventional centrifuge with one disc stack, however, this centrifuge does not allow continuous operation, as the collection pockets have to be emptied at regular intervals.

It is the object of the present invention, based on the prior art, to provide a method for processing a flowable product and to provide a centrifuge which allows an alternative solution for a better separation of particles.

In accordance with the invention, a method for processing a flowable product using a centrifuge, in particular a separator having a vertical axis of rotation, having a rotatable centrifuge drum in which a disc stack, at least one product outlet and at least one solids discharge opening is arranged, has the following steps:

a) pretreating the flowable product so that particles in this product are more strongly attracted by electrically charged components;

b) feeding the flowable product into the disc stack;

c) generating an electric charge on the discs of the disc stack, and d) separating the charged particles from the flowable product within the disc stack (and thus under the influence of electrostatic attractive forces and a centrifugal field)

The targeted use of electrostatic forces in the disc gaps in the centrifugal field of a centrifuge provides a simple means of achieving better separation behavior of particles at the discs of the disc stack. In addition, the already separated particles adhere to the underside of the disc, so that crossing of the particle and product feed streams at the outside diameter of the disc is prevented and thus also that already separated particles can enter the disc stack a second (or third, . . . ) time.

In order to enable the effect of the electrically charged plates on the charged particles over a wide range, it is advantageous if this is generated on the discs of the disc stack by a surface charge.

The electrical field between the discs of the disc stack and the remaining part of the centrifuge isolated from it is generated by impressing a charge from a DC voltage source.

In this process, the positive or negative charge can be transferred from outside to a centrifuge component, wherein one pole of the DC voltage source is in contact with an outer wall of this component and this component is made of electrically conductive material. After charge transfer, this charge is passed on or transferred to the disc stack of the centrifuge.

The pretreatment of step a) is preferably carried out outside the drum. Pretreatment is also preferably carried out in such a way that the particles are attracted by the charge of the disc stack.

The pretreatment in step a) can be carried out after a first advantageous variant of the invention by electrostatically charging the particles, for example outside the centrifuge. In this process, the product to be processed passes a positively or negatively charged electrode, wherein particles, for example solid particles, are charged at the electrode before entering the centrifuge. This electrode is preferably located outside the drum. However, it is also conceivable to integrate them into the feed of the drum.

During the separation process, these charged particles are increasingly drawn by the electrostatically charged discs towards the disc surface, where they are separated and then adhere.

The pretreatment in step a) may be carried out according to an alternative variant of the invention also by adding a ferrofluid in order to achieve the effect mentioned above.

After the separation of the particles in step d), it is advantageous to switch off and/or discharge the electric field at the disc stack so that the separated particles slide more easily from the surface of the disc into the solids chamber.

During polarity reversal or when the electric field is switched off, the degree of separation is reduced by a few percent. In order to avoid unnecessary reversal of polarity or switching off, the separation can be monitored, for example by a probe at a product outlet of the fluid phase or liquid phase. If the proportion of solids exceeds a specified value, the separation onto the disc is insufficient. By monitoring the separation, the method can be adapted to the respective product.

Alternatively, the inlet can be closed while the electrical field is being reversed or switched off.

In accordance with the invention, a centrifuge, in particular a separator, has a centrifugal drum, in particular a continuously operable separator drum with a vertical axis of rotation, in which a disc stack is arranged, wherein the centrifugal drum has at least one product feed for feeding a product to be processed, a disc stack for phase separation and at least one outlet for discharging a liquid phase and an outlet for discharging at least one further phase, in particular a liquid phase or a solid phase. The centrifuge also has at least one means of generating an electric charge on the discs of the disc stack or in disc gaps of the disc stack.

In a separator with electrostatically charged discs, particles are separated in the area of a centrifuge where separation usually takes place without the additional influence of electrostatics. If a product with charged particles is processed with the centrifuge, the separation rate of these charged particles is improved, and crossing of the already separated particles with the product feed stream is prevented.

A suitable DC voltage source can be used to generate an electrical charge on the discs of a disc stack, wherein the level of the generated voltage is preferably adjustable. A positive pole is connected at one point of the separator and a negative pole at another point of the separator. One of the poles is conductively connected to the disc stack. The disc stack is electrically insulated from the outer wall of the centrifuge drum by a coating or other non-conductive material so that a short circuit cannot occur through contact between the two components.

A suitable voltage level for such a DC voltage source is in the range between 5000 and 20000 volts.

For ease of operation, the means for generating an electrical charge on the discs of the disc stack is preferably located outside the centrifuge drum.

In an advantageous embodiment, a first pole of the DC voltage source with positive or negative charge can be arranged on the outer wall of a pump element of the centrifuge, which is connected to the disc stack. For this purpose, the pole only has to be attached to the pump element, no further design adjustments to the centrifuge drum are necessary. This is advantageous, as it allows an existing centrifuge to be retrofitted.

In the following, the invention is described in more detail by means of an embodiment example shown in a drawing.

BRIEF DESCRIPTION OF THE DRAWING

The FIGURE shows a sectional partial view of a separator drum of hermetically sealed design.

DETAILED DESCRIPTION OF THE DRAWING

A rotatable separator drum 1 with vertical axis of rotation D is placed on a turning spindle 2, which is driven by a direct drive or by a belt drive, not shown here.

The turning spindle 2 is conically shaped along an upper circumferential area and is fastened to the lower part of the drum 20 with a fastening means 6.

A product feed pipe 4 is followed by a product feed pipe 5 which rotates during operation and is aligned concentrically to the axis of rotation D. From the product feed pipe 5, product P runs into a distributor 7 with distributor holes or ribs from which the flowable product can exit, e.g., in a radial direction into the interior of the separator drum 1. It is also conceivable (not shown here) to lead the product from the distributor into at least one rising channel in the disc stack.

Inside the separator drum 1, the incoming product flows in disc gaps between conical discs of a disc stack 11 axially spaced by means of spacers.

The product is clarified in the disc gaps (and possibly also separated into two or more liquid phases) in that solid particles of the flowable product are deposited on the undersides of the discs, which can then escape into a solids collection chamber 8. From there, the solid phase SP here is discontinuously discharged in a radial direction from the separator drum 1 via solids discharge openings 10, which can be opened and closed via a piston slide 9. The liquid phase LP is led to a pump element 12 and from there it is discharged through a product outlet 13.

In the present case, better separation of solid particles in the disc gaps of a disc stack is made possible by applying an electric charge to disc stack 11. This also causes particles that have already been separated to adhere to the underside of the disc.

For this purpose, an outer wall 18 of the separator drum 1 or an outer wall 19 of the pump element 12 is connected to a positive and a negative pole of a DC voltage source 14 via an electric line 15*a* or 15*b* respectively.

A component that is easily accessible from the outside, here the outer wall 19 of pump element 12, consists of an electrically conductive material and is conductively connected to the disc stack so that it is charged positively or negatively depending on the connection to the DC voltage source. Another component, such as the actual separator drum 1, is polarized in the opposite direction.

In order to avoid a short circuit, the disc stack 11 is insulated to the inner wall of the separator drum 1, here by one or more non-conductive material layers 16, 17 above and below the disc stack 11. The distributor 7 is also insulated by an upper material layer 17 and a lower material layer 21.

In addition, the lower part of the drum 20 can also be insulated from the rotating spindle 2 by an electrically non-conductive material layer 22.

The product feed pipe 5 and the distributor 7 are preferably made of an electrically non-conductive material or have a non-conductive coating, so that the parts, which are preferably already charged before entering the drum, do not settle or discharge on the components already here.

In the following, the function of the separator of the FIGURE is explained in more detail by means of a method for processing, in particular for clarifying, a flowable product.

In addition, a pre-treatment according to the type of step a) of claim 1 is carried out. According to a variant of this pre-treatment, before entering the rotating separator drum, the product is first guided past a negatively or positively charged electrode of a DC voltage source, so that the solid particles in the product become electrically charged. This electrode can also be arranged alternatively in the product teed pipe 4 or in the feed pipe 5. However, the solid particles can also be loaded at another point before the product flow enters the disc gap of disc stack 11. A suitable voltage level for such a DC voltage source is in the range between 5000 and 20000 volts.

If charging of the solid particles takes place before the flowable product stream enters the separator, it is advantageous if the product feed pipe 5 and the distributor 7 are made of non-conductive material or are coated with non-conductive material so that separation preferably takes place only in the disc stack.

After the product enters drum 1, it enters the disc gap of disc stack 11. The charge of the particles of the product is opposite to the charge of the discs, so that the discs exert an electrostatic attraction on the charged particles, which increasingly collect on the discs. The disc gaps therefore become increasingly narrow over time.

By reversing the polarity or switching off the DC voltage source 14, the collected particles, in particular the solid particles, are then repelled from the disc surface and transported into the solids collection chamber 8 (preferably with interrupted feed).

As already explained, the disc stack will become clogged with time. It is therefore advantageous if this is suitably monitored during operation (e.g., on the basis of the feed quantity or the discharge quantity) and if, depending on the monitoring—or periodically at specified intervals—the polarity of the disc stack is reversed and, optionally, the drum is emptied in order to flush out the deposited particles. For this purpose, the DC voltage source is preferably connected to the control and regulation system of the centrifuge (not shown here).

The FIGURE shows a separator which enables a solid-liquid separation. However, the process can also be applied analogously to three-phase separators. As an alternative to the design of a separator in which separator drum 1 is mounted on a rotating spindle 2, the separation of solids on a charged disc stack can be used in other designs, e.g., with suspended drums.

The method and centrifuge according to the invention are suitable for a wide variety of products, but especially for cleaning a contaminated oil.

It should also be noted that the design as a hermetically sealed machine with a rotating feed pipe and a guiding pump element, in which the product is pumped through the machine, is preferred but not mandatory.

LIST OF REFERENCE CHARACTERS

1 Separator drum
2 Turning spindle
4 Product feed
5 Product feed pipe
6 Fastening means
7 Distributor
8 Solids collection chamber
9 Piston slide
10 Solids discharge opening
11 Disc stack
12 Pump element
13 Product outlet
14 DC voltage source
15*a, b* Power lines
16 Non-conductive material layers
17 Non-conductive material layers
18 Outer wall of separator drum
19 Outer wall of pump element
20 Lower part of the drum
21 Non-conductive material layers
22 Non-conductive material layers
D Axis of rotation
SP Solid phase
LP Liquid phase
P Product

The invention claimed is:

1. A method for processing a flowable product using a centrifuge, wherein the centrifuge includes a vertical axis of rotation with a rotatable centrifuge drum, wherein a disc stack is disposed in the rotatable centrifuge drum, a product outlet for discharging a liquid phase, and a solids discharge opening for discharging a solid phase, comprising the acts of:

a) pretreating the flowable product so that particles in the flowable product become electrically charged;
b) feeding the pretreated flowable product into the disc stack;
c) electrically charging the disc stack; and
d) separating the electrically charged particles from the flowable product within the electrically charged disc stack;

wherein the disc stack is electrically charged by applying a pole of a DC voltage source directly to the disc stack, and further comprising the act of reversing a polarity of the disc stack or disconnecting the disc stack from the DC voltage source.

2. The method according to claim 1, wherein the disc stack and the particles have opposite electrical charges.

3. The method according to claim 1, wherein the reversing or the disconnecting occurs periodically in time or as a function of a clarification behavior in the disc stack.

4. The method according to claim 1, wherein the pretreating is performed before the flowable product is introduced into the rotatable centrifuge drum.

* * * * *